US005582314A

United States Patent [19]

Quinn et al.

[11] Patent Number: 5,582,314

[45] Date of Patent: Dec. 10, 1996

[54] LATCH DEVICE FOR CONTAINER CAP ASSEMBLY

[75] Inventors: Gregory F. Quinn, Fullerton; Robert P. Mayercheck, Irvine, both of Calif.

[73] Assignee: FloTool International, Inc., Tustin, Calif.

[21] Appl. No.: 372,240

[22] Filed: Jan. 13, 1995

[51] Int. Cl.[6] ..... B65D 41/32

[52] U.S. Cl. ..... 220/326; 220/339; 215/237; 215/245

[58] Field of Search ..... 220/256, 259, 220/324, 326, 319–321, 343, 269, 281, 260; 215/216, 221, 224–225, 237, 244–245, 305, 295, 316, 317, 320

[56] References Cited

U.S. PATENT DOCUMENTS

| | | | |
|---|---|---|---|
| 1,471,195 | 10/1923 | Northern . | |
| 1,534,836 | 4/1925 | Brede et al. . | |
| 1,567,393 | 12/1925 | Schlaich . | |
| 3,651,992 | 3/1972 | Hazard | 215/237 X |
| 4,305,515 | 12/1981 | Tontarelli . | |
| 4,353,483 | 10/1982 | Dehr | 215/224 X |
| 4,473,167 | 9/1984 | Bailey | 220/269 X |
| 4,718,567 | 1/1988 | La Vange | 215/237 X |
| 4,760,934 | 8/1988 | Netsch | 220/269 |
| 4,782,964 | 11/1988 | Poore et al. . | |
| 4,790,442 | 12/1988 | Gach | 215/237 X |
| 4,809,874 | 3/1989 | Pehr . | |
| 4,838,441 | 6/1989 | Chernall | 215/237 X |
| 5,031,784 | 7/1991 | Wright . | |
| 5,083,671 | 1/1992 | Hayes | 215/235 X |
| 5,147,054 | 9/1992 | Pehr . | |
| 5,197,624 | 3/1993 | Dodaro | 220/269 X |
| 5,305,900 | 4/1994 | Maguire et al. . | |
| 5,320,232 | 6/1994 | Maguire et al. | 215/237 X |
| 5,335,802 | 8/1994 | Brach et al. | 215/235 |
| 5,392,938 | 2/1995 | Dubach | 215/237 X |

FOREIGN PATENT DOCUMENTS

| | | | |
|---|---|---|---|
| 865056 | 5/1941 | France | 215/305 |
| 2494227 | 5/1982 | France . | |
| 8300284 | 8/1984 | Netherlands . | |

*Primary Examiner*—Allan N. Shoap
*Assistant Examiner*—Nathan Newhouse
*Attorney, Agent, or Firm*—Harold L. Jackson

[57] ABSTRACT

A container cap assembly for capping large bottles, jars and the like that provides a latch device in combination with a container cap assembly which includes a cap body and hinged cover on which is formed a latching tongue adapted to latch to the cap body. The latching tongue is formed having a midsection member that is preferably provided with an arcuate cross-sectional configuration having inwardly bent free edges which define a spring-action biasing means, whereby the free edges are placed in tension when the latching tongue is flexed outwardly away from a protruding lip member formed on the cap body.

20 Claims, 2 Drawing Sheets

3
3
10
10
12
12
14
14
16
16
18
20
20
22
26
28
28
34
34
48
50
50
52
52
54
54
55
55
56
66
66
68
68
70
70
71
71
72
72
74
74

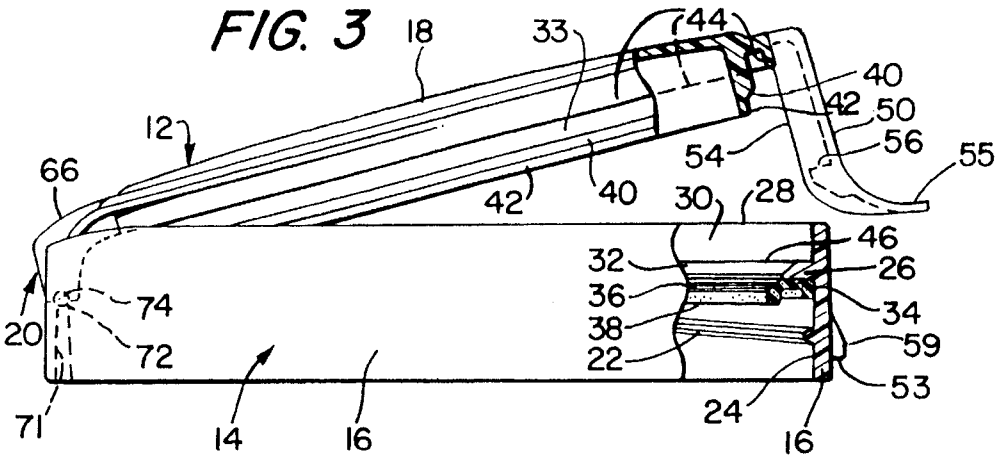
FIG. 3
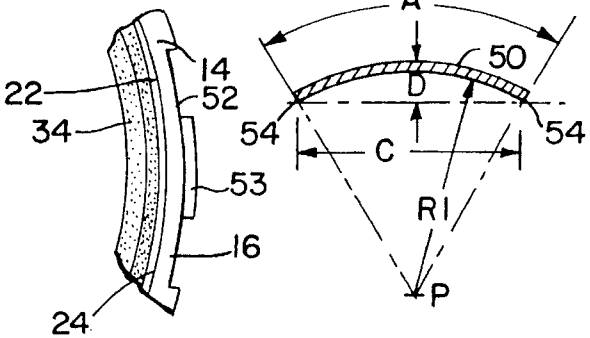
FIG. 6
FIG. 8
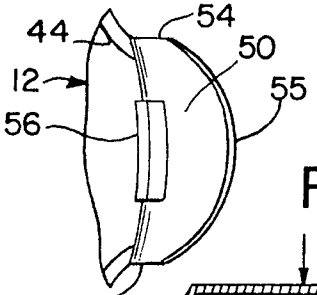
FIG. 7
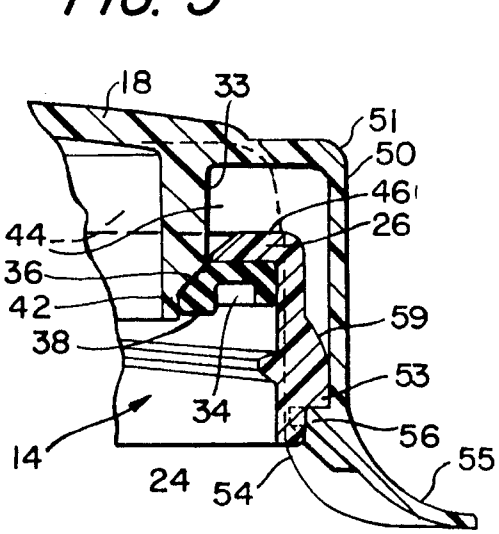
FIG. 5
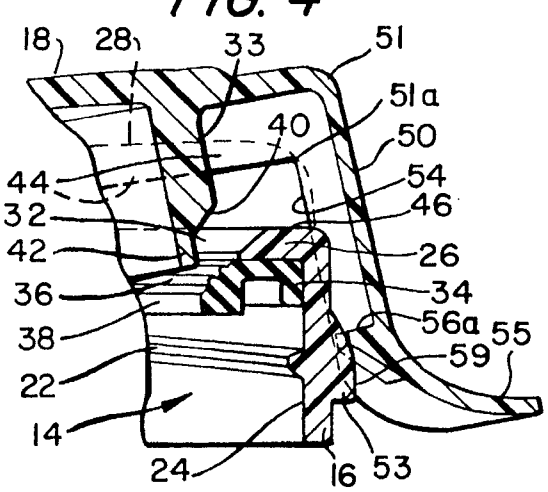
FIG. 4
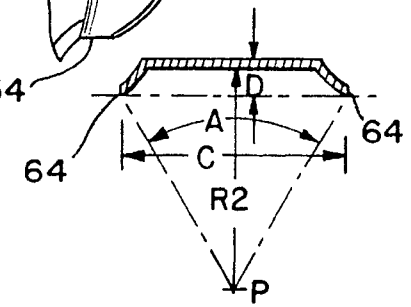
FIG. 9

LATCH DEVICE FOR CONTAINER CAP ASSEMBLY

BACKGROUND OF THE INVENTION

1. Field of the Invention

The present invention relates to a container cap assembly for capping all sizes of bottles, jars and the like, and more particularly to a latch device in combination with a container cap assembly that includes a hinged cover or lid and a main threadable cap body on which is formed a novel latching device positioned therebetween. The threadable cap body and hinged cap cover include a sealing means that is defined by a gasket mounted in the cap body and a sealing member formed as part of the hinged cover.

2. Description of the Prior Art

There are many known varieties and shapes of container caps including bottle-type caps that have been and are presently in use. The known caps differ in configuration and arrangement in that some are formed as just single cap members having a cooperative sizes to conform to the sizes of the containers or bottles. Some are defined as simple snap-on caps and others are provided with internal threads arranged to match the threaded arrangements of particular designed containers.

Conventional snap-lid type of caps inherently do not provide a positive seal to establish a long shelf life for liquids or edibles stored therein. The caps are commonly formed from plastic materials and are snapped onto the container mouth. Such bottle caps as these are generally not provided with any type of sealing means such as gaskets.

Threaded lids generally include gaskets, but are not handy to use, especially for large mouth containers.

Another type of container cap is one formed with a cap body that generally includes internal threads and a hinged cap lid. Generally, the two-member cap is often found to include various types of sealing arrangements which require latching or locking devices so as to assure a tighter seal between the container, the cap body and its associated hinged lid. However, such a cap device must allow for repeated ease of access to the contents within the container.

SUMMARY OF THE INVENTION

The present invention comprises a container cover or lid member hingedly mounted to a cap body that is internally threaded so as to be readily secured to any compatible threaded neck portion of a container, bottle or large jar. The cap body is defined by an annular wall which is formed with an inwardly extended annular flange. An annular gasket is positioned under the flange so as to engage the annular lip of the open end of a container and to engage with a depending rim of the container lid member, whereby a tight seal is provided between the lid and the cap body, and between the cap body and the container.

The tightly sealed container cap includes a novel latching device that is preferably defined by an arcuate latching tongue having outer parallel edges that provide a spring action, and a latching hook integrally formed thereon as part of the container lid. The latching tongue is thus adapted to securely latch to a corresponding latchable lip member formed on the outer surface of the annular wall structure of the cap body.

Accordingly, it is an important object of the present invention to provide a container cap that includes a novel latching device which can be used on containers of various sizes.

Another object of the invention is to provide an improved container cap device that includes a positive sealing arrangement in combination with a unique latching device that establishes a tight seal between the cap lid and the cap body member.

Still another object of the present invention is to provide a sealable and lockable lid having the above characteristics, wherein the latching device comprises a downwardly extended latching tongue that is formed with an arcuate cross-sectional configuration that has a radius equal to or less than the mouth of a container, whereby a positive locking and sealing arrangement is created between the lid and the cap body member.

A further object of the present invention is to provide a container cap of this character wherein the radius of the arcuate configuration of the hook member is equal to the radius of the arcuate configuration of the lip member, whereby structural fatigue is considerably reduced, thus extending the life of the latching device and in turn extending the integrity of the locking action between the lid and the cap body.

Still another object of the present invention is to provide a latching device that is defined by a latching tongue having outer parallel edges that are arranged inwardly of the tongue surface so to be placed in tension when the latching tongue is flexed, thereby providing a spring action with respect to the movement of the tongue.

Still a further object of the present invention is to provide a novel latching device of this character that aids in establishing a positive sealing action between the hinged lid and fixed cap body, and yet is simple and rugged in construction and relatively inexpensive to manufacture.

Yet another object of the present invention is to provide a container cap in combination with a novel latching device that can be readily employed with a great variety of jars, bottles and like containers having different sizes of openings. This has not been possible with the other known cap devices.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

BRIEF DESCRIPTION OF THE DRAWINGS

Novel features and advantages of the present invention in addition to those mentioned above will become apparent to those skilled in the art from reading the following detailed description, in conjunction with the accompanying drawings wherein:

FIG. 3 is a side-elevational view of the container cap with the lid in an unlatched upward position showing a portion thereof broken away;

FIG. 4 is an enlarged cross-sectional view of the latching device in a unlatched position;

FIG. 5 is an enlarged cross-sectional view of the latching device in a latched position and the lid in sealed engagement with the annular gasket mounted in the cap body;

FIG. 6 is a bottom plan view of a portion of the underside of the cap body showing the latching lip extending from the wall thereof;

FIG. 7 is a bottom plan view of the underside of the latching tongue showing the position of the lip member integrally formed on the latch tongue;

FIG. 8 is a diagrammatic cross-sectional view of an arcuate latching tongue;

FIG. 9 is a diagrammatic cross-sectional view of an alternative configuration of a latching tongue.

DESCRIPTION OF THE PREFERRED EMBODIMENT

Figures 1, 2, 10:
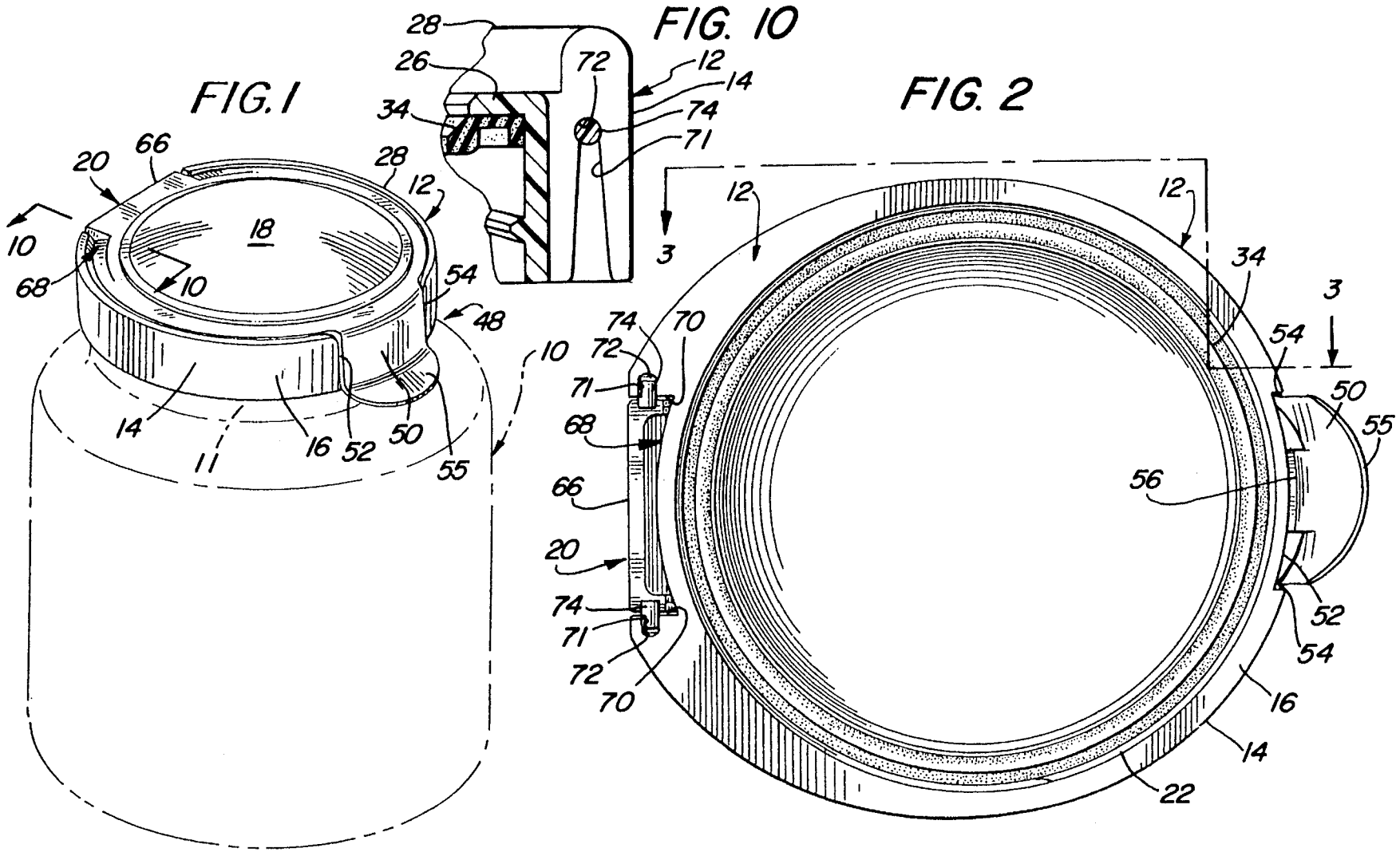
FIG. 1 is a pictorial view of the present invention which is defined as a container cap.
FIG. 2 is an enlarged bottom plan view of the container cap in a sealed and latched position.
FIG. 10 is a cross-sectional view taken substantially along line 10—10 of FIG. 1 showing the hinge arrangement between the cover and the cap body.

Referring more particularly to FIG. 1, there is shown a pictorial view of a container 10 having a neck portion 11 on which is commonly formed an external thread (not shown). It should be readily understood that container 10 substantially represents various types and sizes of containers, such as bottles, jars and the like, that hold liquids as well as dry food products.

A container cap assembly, generally designated at 12, is shown mounted on the container 10 and is formed from a suitable rigid or semirigid thermoplastic material of polyolifin group such as a high density polyethylene, more preferably from a polypropylene that provides flexibility and memory. Polypropylene is the least expensive of most commonly used plastics for molding consumer products and thus advantageous from the cost standpoint. However, polypropylene has poor strength characteristics with respect to bending stresses. We have discovered that a curved latch design of the present invention takes advantage of the low cost of polypropylene while overcoming the inherently low strength characteristics. The container 10 is illustrated as a large mouth container, for example, 110 mm thread diameter.

The container cap assembly 12 comprises a threadable cap body 14, as illustrated in FIGS. 2 and 3, which is formed with an annular wall 16 to which a cover or lid member 18 is hingedly attached by a suitable hinge means, indicated generally at 20. Accordingly, hinge means 20 allows cover 18 to be rotated between an open position and a closed position when the cap body 14 is securely threaded to the container 10.

The main cap body 14 is thus provided with suitable internal threads 22 that are formed on the inner surface 24 of wall 16, wherein wall 16 is further formed with an internal flange member 26 (FIG. 10) that is an integral part of wall 16 which is positioned just below the outer annular open end or mouth defined by an annular upright lip 28 of wall 16. Together, internal flange member 26 and annular upright lip 28 define an annular recess 30 (FIG. 3) which is adapted to receive cover 18 therein in a substantially low-profile arrangement, as illustrated in FIGS. 1 and 5.

Along the inner annular rim of flange member 26 there is formed a beveled edge 32 (FIGS. 3 and 4) which is provided with an inner diameter substantially equal to the outer diameter of a seal engaging member 33 that is integrally formed as part of cover 18. A sealing gasket 34 is mounted under flange 26 and is provided with a depending, beveled, peripheral rim 36 and a depending lip 38 that extends beyond the inner diameter of the beveled edge 32 so as to respectively engage the depending beveled edge 40 and extended lip 42 of sealing ring 33, as illustrated in FIG. 5. When beveled edge 40 engages sealing gasket 34 the annular peripheral wall 44 of cover 18 butts against the upper surface or shoulder 46 of flange member 26, as seen in FIG. 5. It should be noted that the cross section of the annular wall 44 has been eliminated from FIGS. 4 and 5 to simplify these figures, but the annular wall 44 is shown in cross section in FIG. 3.

A latching means, designated generally at 48 (FIG. 1), which defines a positive locking apparatus, is positioned diametrically opposite the hinge means 20, and is formed as part of the cover or lid 18 and cap body 14. The top surface of the cover 18 is preferably slightly convex as is illustrated in FIG. 3. The latching means 48 comprises a latching tongue 50 which is integrally formed with the annular peripheral wall 44 of the cover 18 and projects outwardly and downwardly therefrom so that, when in a latched position, tongue 50 latches to the fixed cap body 14, as illustrated in FIG. 5. It should be noted that tongue 50 is the preferred form and is arcuately formed, as seen in FIGS. 7 and 8. However, the tongue may be formed so as to have an alternative midsection configuration, as indicated and shown in FIG. 9, which will be explained hereinafter.

The length of tongue 50 from its junction 51 with the cover 18 to its free end ranges from between about ¾" to 1¼" and is preferably about 1" long. The distance from the upper surface **56*a* of the hook member 56 (FIG. 4) to the junction 51*a* of the free edges of the tongue 50 and the cover 18 is preferably within the range of about ½" to 1" and most preferably about ⅝" to ¾. The radius Ri of tongue 50 should be at least equal to or less than the radius of cap body 14. However, the radius of the arcuate tongue is preferably less than the radius of the cap body, for example, Ri is within about 60% to 100% and most preferably about 70%–85% of the radius of the cap body so as to provide a more suitable positive locking engagement when the tongue is latched to the cap body. As an example, if cap body 14 is formed having a 2½" radius then tongue 50, as diagrammatically illustrated in FIG. 8**, may be formed having a radius "Ri" that equals about 1¾" to 2" with an arc "A" equal to about 25° to 90° and most preferably about 45° to 55°.

In this first example both "Ri" and "C" are about equal. For a cap assembly arranged to fit a 4¼" to 4½" diameter container opening the height "D" of the apex of the arcuate tongue (with respect to a chord extending between the free edges) may be about ⅛" to 5/32". See FIG. 8. The ratio between "C" and "D", for example, D divided by C depends upon the arc A. For an arc of about 35° to 45° the ratio of D divided by C is within the range of 0.06 to 0.10.

The free ends or edges 54 of tongue 50 are curved or bent inwardly to provide a spring-action biasing means. It has been found that by making the tongue in the form of an arc or similar shape the free edges are placed in tension when the tongue is flexed outwardly away from the cap body 14. Tongue 50 is formed with an integral, inwardly extended, hook member 56 which is positioned adjacent a finger engaging member 55. Hook member 56 and particularly the upper surface **56*a* thereof is adapted to securely latch under a corresponding protruding lip member 53 formed on the outer surface of recess 52 of the annular wall 16 of cap body 14. Latch hook 56 of the tongue and latchable lip member 53 are both arcuately formed with a substantially identical radius. That is, lip member 53 has substantially the same radius as the radius of hook 56**.

Referring to FIG. 4, as the lid 14 is rotated to a closed position, as indicated in FIG. 4, the corresponding arcs of the latch hook 56 and the lip 53 allow latch hook 56 to ride over the protruding surface 59 of the lip 53 in a substantially smooth operation aided by the spring action that is built into tongue 50. Thus, the corresponding arcs of the engaging hook 56 and lip 53 prevent wear and add considerable life to the latching operation, and in turn provide a continuous substantially airtight seal between the lid and the cap body.

Referring to FIG. 8, the lineal distance of a chord drawn between the free edges 54 of the latching tongue is designated as "C" and the depth of apex of the central section with respect to chord C is designated "D" as shown.

An alternative arrangement is that of a tongue 50*a* illustrated in the diagrammatic view of FIG. 9, wherein a substantially flat tongue member 61 is shown as having oppositely disposed side members 62 bent downwardly so as to provide the spring action as described heretofore for tongue 50. However, "R2" is the distance from a given point "P" to the flat tongue member, "C" is the distance between free edges 64, and "A" is the angular displacement of side members 62. "D" indicates the depth established between free edges 64 and flat tongue member 61. It is important to note that the thickness of the tongue, no matter what cross-sectional configuration that might be employed, is preferably in the range of 0.050 to 0.125, and most preferably between 0.055 and 0.080 inches.

Referring now to FIGS. 2, 3 and 10, there is illustrated a hinge means 20 comprising an outwardly extended hinge plate 66 that is integrally formed as part of cover 18. Hinge plate 66 extends downwardly so as to be positioned within an elongated recess 68 formed in the cap body 14, whereby oppositely disposed walls 70 are defined by the recess. Each wall is provided with tapered groove 71 which includes an enlarged opening at its lower end and an upper end that terminates at bore 72. Bore 72 has a diameter less than that of hinge pin 74 which is formed as part of hinge plate 66. The upper terminating end is slightly smaller that the diameter of hinge pin 74 which allows the pin to snap securely into bore 72. This arrangement allows cover or lid 18 to open between 120 and 130 degrees relative to the opening of the container, thereby providing easy access to the container without the necessity of removing the cover.

The foregoing should only be considered as illustrative of the principles of the invention. Further, since numerous modifications and changes may readily occur to those skilled in the art, it is not desired to limit the invention to the exact construction and operation as shown and described and, accordingly, all suitable modifications and equivalents may be resorted to, falling within the scope of the claimed invention. For example, the container on which a cap containing the novel latching means and/or the hinge means of our invention need not be cylindrical but may be square or rectangular in shape. Where a noncylindrical container is to be accommodated the cap body may be molded integrally with the container.

What is claimed is:

1. A container cap assembly for providing a closure for large mouth container having male threads surrounding an open end thereof comprising:

an annular cap body with an outer and inner surface, the inner surface of the cap body having female threads thereon for cooperation with matching male threads on the container, the cap body having a lip member extending outwardly from the outer surface and integrally formed with the cap body; and an integrally molded lid member having a top surface, a bottom surface and a periphery hinged to the cap body, the lid member including a convex-shaped top portion, an annular wall extending downwardly from the bottom surface of said lid member at said periphery and a latching tongue molded integrally with the annular wall, the latching tongue extending downwardly from the annular wall and having free side edges and an arcuate cross section extending between the free side edges and joined to the annular wall, the tongue further having a hook member adjacent the lower end thereof formed integrally therewith, the hook member extending inwardly therefrom for engaging the lip member on the cap body, the radius of the arcuate cross section of the tongue encompassing an arc defining an angle within the range of about 25° to 90°.

2. The cap assembly of claim 1 wherein the free edges of the tongue extend downwardly to the hook member within the range of about ½" to 1".

3. The cap assembly of claim 2 wherein the cap body and lid member are molded of a polyolifin plastic.

4. The cap assembly of claim 3 wherein the cap body and lid member are molded of polypropylene.

5. The cap assembly of claim 3 wherein the arcuate cross section of the tongue encompasses an arc which defines an angle with the range of about 45° to 55°.

6. The cap assembly of claim 1 wherein the ratio of lineal length C between the free side edges of the latching tongue and the depth D of the central section of the tongue is within the range of about 0.10 to 0.125.

7. In a hinged container cap assembly for providing a releasably lockable lid on a container having an externally threaded neck portion terminating in an opening, the combination comprising:

a cap body having an annular wall with an outer surface and an inner surface defining an access opening, the inner surface having threads for threadably engaging the external threads on the neck portion of the container, whereby the access opening is concentric with the opening in the container;

an integrally molded lid member having a top surface, a bottom surface, a periphery, a continuous convex-shaped top portion and a downwardly extending annular wall at the periphery of said lid member;

a hinge pivotally connecting the lid member and the cap body, whereby the lid member is arranged to pivot between a closed position in which the opening in the container is closed and an open position in which unobstructed access is provided through the opening in the container; and latching means arranged to releasably lock the lid member to the cap body, the latching means comprising a lip member formed on the lower portion of the outer surface of the annular wall of the cap body opposite the hinge and an arcuate tongue integrally formed with a portion of the annular wall of the lid member and extending downwardly therefrom, the tongue terminating in a lower end extending outwardly to form a finger engaging member for accommodating the finger of a user desiring to open the latching means and having an inwardly extending hook member which releasably snaps over the lip member when the lid is in the closed position, the tongue further including two free longitudinal side edges, the free side edges being placed in tension to provide a spring action when the tongue is flexed outwardly away from the cap body so that the hook member can snap over the lip member to close and open the lid member.

8. A container cap assembly as recited in claim 7 wherein the lid member has a convex-shaped top portion and wherein the cap body and the lid member are molded of polyolifin and further including a sealing gasket disposed between the cap body and the lid member for providing a positive seal therebetween when the lid member is in the closed position.

9. A container cap assembly as recited in claim 8 wherein the cap body and Lid member are molded of polypropylene.

10. A container cap assembly as recited in claim 8, wherein the latching tongue is defined as having a radius equal to or less than the radius of said cap body and wherein the length of the free side edges of the tongue to the hook member is within the range of about ½" to 1".

11. A container cap assembly as recited in claim 8, wherein the length of the free edges to the hook member is about ¾".

12. A container cap assembly as recited in claim 8, wherein said hinging means comprises:

an elongated recess formed in the annular wall of said cap body defined by oppositely disposed side walls, each having a tapered groove with an enlarged open end and an oppositely reduced open end terminating in a pin receiving bore; and a depending hinge plate integrally formed in said lid member, said hinge plate including laterally extended hinge pins arranged to be positioned in said respective tapered groove, whereby said pins are rotatably mounted in said respective bores.

13. A container cap assembly as recited in claim 8, wherein the radius of said latching tongue is less that the radius of said cap body.

14. A container cap assembly as recited in claim 8, wherein the arc of said tongue extends along an angle within a range of about 25° to 90°.

15. A container cap assembly as recited in claim 8, wherein the arc of said tongue extends along an angle within a range of 45° to 55°.

16. A container cap assembly as recited in claim 8 wherein the ratio of lineal length C between the free side edges of the latching tongue and the depth D of the central section of the tongue is within the range of about 0.10 to 0.125.

17. A container cap assembly as recited in claim 7, wherein the length of said tongue from its junction with the annular wall to the lower end thereof is within the range of about ¾" to 1¼".

18. A container cap assembly as recited in claim 7, wherein the length of the free side edges of the tongue to the hook member is within the range of about ½" to 1".

19. A container cap assembly for providing a sealed closure for large mouthed containers having male threads surrounding on open end thereof comprising:

a cap body having an annular wall defining an access opening with an outer and inner surface, the inner surface having female threads for engaging the male threads on the container;

an integrally molded lid having a top surface, a bottom surface, a periphery, a continuous convex top portion and downwardly extending annular wall at the periphery of said lid member;

a hinge pivotally connecting the lid and the cap body to allow the lid to pivot between a closed position in which the container is closed and an open position in which unobstructed access is provided through the opening in the container;

a protruding lip formed on the outer surface of the lower portion of the annular wall of the cap body opposite the hinge;

an arcuate latching tongue integrally molded as part of the lid and extending downwardly from the annular wall thereof, the tongue having free side edge portions and a lower end formed with an inwardly extending hook which releasably snaps over the protruding lip on the cap body when the tongue is flexed outwardly to close or open the lid, the free side edge portions of the tongue being placed in tension when the tongue is flexed outwardly; and a sealing gasket disposed between the cap body and the lid for providing a positive seal between the lid and cap body when the lid is in the closed position.

20. The container cap assembly of claim 19 wherein the sealing gasket is carried by the cap body.

* * * * *